US010328332B2

(12) United States Patent
Kribib

(10) Patent No.: US 10,328,332 B2
(45) Date of Patent: Jun. 25, 2019

(54) MACHINE FOR SETTING UP BOWLING PINS ENABLING SELECTION OF THE SET-UP OF ONE OR A PLURALITY OF PINS IN CHOSEN POSITIONS

(71) Applicant: MULTI INTERVENTIONS BOWLING (MIB), Valentigney (FR)

(72) Inventor: Hicham Kribib, Ancenis (FR)

(73) Assignee: MULTI INTERVENTIONS BOWLING (MIB), Valentigney (FR)

( * ) Notice: Subject to any disclaimer, the term of this patent is extended or adjusted under 35 U.S.C. 154(b) by 19 days.

(21) Appl. No.: 15/322,638

(22) PCT Filed: Apr. 24, 2015

(86) PCT No.: PCT/FR2015/051128

§ 371 (c)(1),
(2) Date: Dec. 28, 2016

(87) PCT Pub. No.: WO2016/001498

PCT Pub. Date: Jan. 7, 2016

(65) Prior Publication Data

US 2017/0182400 A1 Jun. 29, 2017

(30) Foreign Application Priority Data

Jun. 30, 2014 (FR) ..... 14 56114

(51) Int. Cl.
*A63D 5/09* (2006.01)
*A63D 5/08* (2006.01)
*A63B 69/00* (2006.01)

(52) U.S. Cl.
CPC ..... *A63D 5/09* (2013.01); *A63B 69/0046* (2013.01); *A63D 5/08* (2013.01)

(58) Field of Classification Search
CPC ..... A63D 5/08; A63D 5/09
See application file for complete search history.

(56) References Cited

U.S. PATENT DOCUMENTS 2,767,984 A * 10/1956 Zuercher ..... A63D 5/08 193/16
3,094,327 A * 6/1963 Whang ..... A63D 5/08 221/7

(Continued)

FOREIGN PATENT DOCUMENTS

CN 2234291 Y 9/1996
WO 2006009948 A2 1/2006

OTHER PUBLICATIONS

English translation of the Written Opinion of the International Searching Authority dated Jun. 25, 3015 for corresponding International Application No. PCT/FR2015/051128, filed Apr. 24, 2015.

(Continued)

*Primary Examiner* — William M Pierce
(74) *Attorney, Agent, or Firm* — David D. Brush; Westman, Champlin & Koehler, P.A.

(57) ABSTRACT

A machine for setting up bowling pins in predetermined positions. The machine includes: a movable distributing arm, suitable for releasing the pins one by one each at one of the predetermined positions, and a primary system for positioning the distributing arm with respect to the predetermined positions. The primary system is devised for an operating cycle moving the distributing arm according to a fixed sequence. A lifting wheel sweeps away the pins and delivers the pins to the distributing arm. A motor moves the distributing arm, the primary positioning system and the lifting wheel (3). A secondary system interferes with the primary positioning system enabling the user to define a position chosen from the predetermined positions with a view to the set-up, by the machine, of a pin in the chosen position.

8 Claims, 3 Drawing Sheets

(56) References Cited

U.S. PATENT DOCUMENTS

| | | | | | |
|---|---|---|---|---|---|
| 3,179,410 | A | * | 4/1965 | Elliott | A63D 5/08 198/481.1 |
| 3,231,272 | A | * | 1/1966 | Blewitt, Jr. | A63D 5/08 473/65 |
| 3,245,684 | A | * | 4/1966 | Congelli | A63D 5/08 294/87.24 |
| 3,248,109 | A | * | 4/1966 | Blewitt, Jr. | A63D 5/08 193/23 |
| 3,526,401 | A | | 9/1970 | Zuercher | |
| 4,754,967 | A | * | 7/1988 | Edler | A63D 5/08 473/57 |

OTHER PUBLICATIONS

International Search Report dated Jun. 25, 3015 for corresponding International Application No. PCT/FR2015/051128, filed Apr. 24, 2015.

Written Opinion of the International Searching Authority dated Jun. 25, 3015 for corresponding International Application No. PCT/FR2015/051128, filed Apr. 24, 2015.

* cited by examiner

MACHINE FOR SETTING UP BOWLING PINS ENABLING SELECTION OF THE SET-UP OF ONE OR A PLURALITY OF PINS IN CHOSEN POSITIONS

CROSS-REFERENCE TO RELATED APPLICATIONS

This application is a Section 371 National Stage Application of International Application No. PCT/FR2015/051128, filed Apr. 24, 2015, the content of which is incorporated herein by reference in its entirety, and published as WO 2016/001498 on Jan. 7, 2016, not in English.

FIELD OF THE DISCLOSURE

The field of the invention is that of the design and manufacture of bowling equipment. More specifically, the invention relates to a machine for setting up bowling pins in predetermined positions, and in particular, but not exclusively, machines envisaged for positioning ten pins in a predetermined position so as to define a triangle.

BACKGROUND OF THE DISCLOSURE

It is noted that the general layout of a bowling lane is as follows.

A lane per se (having a length of approximately 17 meters, or 60 feet) separates a release zone where the player throws his/her ball, a target zone wherein the pins are arranged, generally ten in number.

In the target zone, the pins are arranged so as to define a triangle, in four successive rows as follows:

- first row upstream from the target zone, with a single pin centred along the lane width;
- a second row with two pins, distributed symmetrically with respect to the single pin of the first row;
- a third row with three pins, arranged in a staggered fashion with respect to the pins of the second row;
- a fourth row with four pins, arranged in a staggered fashion with respect to the pins of the third row.

According to the tradition of the game, each pin position is designated by a number, assigned as follows (according to a top view of the target zone and with the pin of the first row at the bottom): the position of the first row bears the number 1, the pins of the second row bear the numbers 2 and 3 from the left, the pins of the third row bear the numbers 4, 5 and 6 from the left, and the positions of the fourth row bear the numbers 7, 8, 9 and 10, from the left.

According to the conventional proceedings of the game, each player has two throws at his/her turn to throw. If after the first throw, the player has knocked down all the pins, the player is said to have made a "strike" and does not carry out his/her second throw. On the other hand, if one or more pins remain in the target zone after the first throw, the player has a second throw to try to knock down the remaining pins and, if applicable, bowl a "spare".

In bowling terminology, "split" is the term designating after the first throw, the gap(s) between the remaining pins. Various "split" configurations can obviously be envisaged, including the least favourable scenario wherein the pins remain at the two positions 7 and 10.

At the present time, bowling alleys are all equipped with automated systems envisaged to carry out the following functions:

- collect knocked-down pins;

- knock down the pins knocked down after the two throws bowled by a player;
- set up the set of ten pins on the predetermined positions;
- return the ball to the player, to the release zone.

Obviously, further functions are also proposed, such as automatic score counting in particular.

According to a widely used technique, the machine for setting up bowling pins at predetermined positions comprises:

- a distributing arm, movable so as to be able to release the pins one by one each at predetermined positions;
- a system for positioning the distributing arm with respect to the predetermined arrangements;
- a lifting wheel to which the knocked-down (or not) pins are conveyed at each change of player, the wheel being designed to sweep away the pins to deliver same to the distributing arm;
- motor means envisaged to move the distributing arm, the system for positioning the distributing arm and the lifting wheel.

According to this technique, the system for positioning the distributing arm acts in operating cycles, an operating cycle providing for the set-up of a pin on each predetermined position.

In the case of a game with ten pins, the positioning system conveys the distributing arm in correspondence with each of the predetermined positions, in order to set up the pins one after the other until positions 1 to 10 are occupied.

By way of indication, the conventional operating cycle of the positioning system acts according to the following fixed sequence: a pin is set up at position 1, followed by another at position 3, followed by another at position 2, followed by another at position 4, followed by another at position 7, followed by another at position 8, followed by another at position 5, followed by another at position 6, followed by another at position 10 and finally a final one at position 9.

During training, a player works on the "splits" that arise. In other words, the player throws a first ball, and observes the "split" that occurs. Therefore, the player needs to systematically throw a first ball to subsequently work on a "split" which is discovered on the fly. It is thus easily understood that the player's training could be optimised if he/she was able to work on the same "split" several times in succession in order to perfect his/her technique, preferentially by saving the physical energy from throwing the first ball.

SUMMARY

An exemplary embodiment of the invention proposes a machine for setting up bowling pins in predetermined positions which enable the player to train on the "splits" of his/her choice, based on a number of pins and positions chosen for these pins.

The aim of the invention is also that of providing such a machine for setting up bowling pins which is simple and convenient to use for a player during his/her training phase.

A further aim of the invention is that of providing such a machine for setting up bowling pins which is simple and quick to install.

These aims along with others which will emerge hereinafter are achieved by means of the invention which relates to a machine for setting up bowling pins in predetermined positions, comprising:

- a movable distributing arm, suitable for releasing the pins one by one each at one of the predetermined positions;

a primary system for positioning the distributing arm with respect to the predetermined positions, the primary system being devised for an operating cycle moving the distributing arm according to a fixed sequence;

a lifting wheel suitable for sweeping away the pins and delivering same to the distributing arm;

motor means envisaged to move the distributing arm, the primary positioning system and the lifting wheel, characterised in that it comprises a secondary system intended to interfere with the primary positioning system, the secondary system comprising:

means for controlling the rotation of the lifting wheel so that it stops after each pin delivered to the distributing arm;

selection means enabling a user to define a position chosen from the predetermined positions with a view to the set-up, by the machine, of a pin in the chosen position, means for activating/shutting down the primary system authorising the operating cycle of the primary system until the chosen position has been reached.

As such, by means of the invention, it is possible for a player to optimise his/her training by defining the number of pins that he/she seeks to arrange in the target zone, along with the respective positions thereof. He/she can thus work on a second throw scenario in a repeated manner, thus substantially improving his/her ability to adjust his/her throw with respect to the scenario in the target zone.

Moreover, it is understood that such an upgrade of machines for setting up bowling pins can be integrated in existing establishments with relatively quick technical interventions. Indeed, the existing machines, with the primary positioning systems thereof, can be retained, the upgrade consisting of the installation of the secondary system according to the invention, added to the primary system.

According to a preferential solution, the control means comprise at least one presence sensor of a pin on the distributing arm.

The presence of a pin on the distributing arm is thus clearly ensured and, if applicable, the rotation of the lifting wheel is stopped (whereby the rotation thereof may be resumed if required, in particular if the player has selected a plurality of pins to be set up, as will be explained hereinafter).

In this case, the control means advantageously comprise disengaging means between the motor means and the lifting wheel, the disengaging means being controlled by the presence sensor.

According to one advantageous embodiment, the disengaging means consist of at least one electromagnetic pulley.

Such a choice of components for the disengaging means is advantageous in terms of spatial requirements, for facilitating installation and for the ability thereof to be controlled by electrical signals.

According to one preferential embodiment, the primary system comprises a wheel having a track defining the operating cycle moving the distributing arm, the track having a succession of sections each suitable for conveying the distributing arm into one of the predetermined positions, the means for activating/shutting down the primary system comprising:

at least one marker for each section;

means for reading the markers of the sections;

means for controlling the rotation of the wheel suitable for comparing the chosen position with the markers of the sections with a view to stopping the wheel when the marker of a section corresponds to the chosen position.

In this way, the operation of the primary system is retained, with the wheel thereof having a track for defining operating cycles by successive sections, each section corresponding to one of the predetermined positions.

As such, the activation/shutdown means integrated in the secondary system and enabling the activation or shutdown of the primary system control the rotation of the wheel consisting of the successive sections until the distributing arm conveyed to one of the predetermined positions by the one of the sections corresponds to the position chosen by the player.

In this case, the means for controlling the wheel preferentially comprise primary disengaging means between the motor means and the wheel, the primary system comprising a control lever of the primary disengaging means, the means for controlling the rotation of the wheel comprising a system for actuating the control lever.

According to such an embodiment, the system for actuating the control lever preferentially comprises an automatic control system envisaged to actuate the lever with successive pulses until the marker of a section corresponds to the chosen position.

According to one advantageous embodiment, the means for reading the markers of the sections comprise at least one inductive sensor.

According to one preferential embodiment, the selection means are integrated in portable computing means.

These selection means may for example be integrated in a smartphone or in a tablet, in this case obviously equipped with a software application provided for this purpose.

The invention also relates to a secondary system intended to be integrated in machines for setting up bowling pins in predetermined positions comprising:

a movable distributing arm, suitable for releasing the pins one by one each at one of the predetermined positions;

a primary system for positioning the distributing arm with respect to the predetermined positions, the primary system being devised for an operating cycle moving the distributing arm according to a fixed sequence;

a lifting wheel suitable for sweeping away the pins and delivering same to the distributing arm;

motor means envisaged to move the distributing arm, the primary positioning system and the lifting wheel, characterised in that the secondary system is intended to interfere with the primary positioning system and comprises:

means for controlling the rotation of the lifting wheel so that it stops after each pin delivered to the distributing arm;

selection means enabling a user to define a position chosen from the predetermined positions with a view to the set-up, by the machine, of a pin in the chosen position, means for activating/shutting down the primary system authorising the operating cycle of the primary system until the chosen position has been reached.

As such, as described above, the machine may be proposed and installed as a whole in a manner including both the primary system and the secondary system. It is however possible to use existing machines already provided with the primary system thereof, by merely installing the secondary system.

BRIEF DESCRIPTION OF THE DRAWINGS

Further features and advantages of the invention will emerge more clearly on reading the following description of a preferential embodiment of the invention, given by way of mere illustrative and non-limiting example, and appended drawings wherein.

DETAILED DESCRIPTION OF ILLUSTRATIVE EMBODIMENTS

Figure 1:
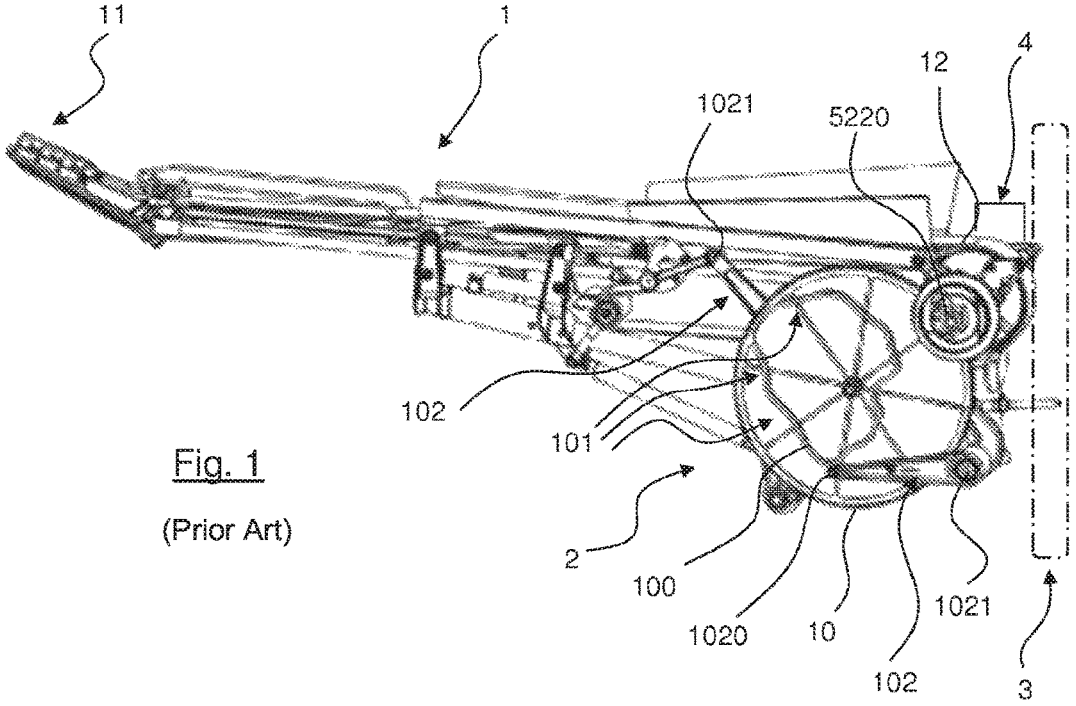
Fig. 1 (Prior Art)
FIG. 1 is a side view of a machine for setting up bowling pins in predetermined positions, suitable for being equipped according to the invention.

With reference to FIG. 1, a machine for setting up bowling pins in predetermined positions comprises a basic structure comprising the following features:

- a distributing arm 1 which is movable and suitable for releasing the pins one by one each at predetermined positions;
- a primary system 2 for positioning the distributing arm with respect to the predetermined positions;
- a lifting wheel 3 intended to deliver the pins to the distributing arm;
- motor means 4 envisaged to move the distributing arm, along with the primary positioning system and the lifting wheel.

Such a machine may further include a system for conveying knocked-down pins to the lifting wheel. In this instance, this conveying system consists, according to the embodiment illustrated by FIG. 2, of a conveyor belt 6 which conveys the pins to the base of the lifting wheel which integrates means known per se to convey the pins from the central belt up to the distributing arm whereon they are delivered one by one.

As featured in FIG. 1, the distributing arm comprises two elements extending from one another, i.e.:

- a first conveyer element 12, in the form of an endless belt and extending from the lifting wheel 3;
- an end element 11, pivotally mounted at the end of the first conveyor element, so as to tilt downwards under the weight of a pin and to unload same in the predetermined position corresponding to the position of the distributing arm (elastic return means tending to return the end element to the high position in the absence of pins on the end element.

Furthermore, the distributing arm, via the first conveyor element, is pivotally mounted about a vertical axis suitable for orienting the distributing arm with respect to the lane width, the distributing arm being further movably mounted in translation along the longitudinal axis of the lane. As such, the combination of the movements of orientation of the distributing arm and translation along the longitudinal axis of the lane enables the distributing arm to unload the pins in all the predetermined arrangements on the target zone of the lane.

In order to move the distributing arm in correspondence with the various predetermined positions, the machine integrates a primary system 2 for positioning the distributing arm.

This primary system comprises:

- a wheel 10 having a track 100 defining the operating cycle moving the distributing arm. This track 100 has a succession of sections 101 each suitable for conveying the distributing arm into one of the predetermined positions.

For this, the wheel has a track 100 on each of the faces thereof, each of the tracks being connected to the end of a slave lever 102. One end 1020 of each slave lever is connected to the corresponding track and is moved as the feed of the sections progresses. The other end 1021 of the slave levers 102 is connected to the distributing arm such that the combined movements of the slave levers 102 during the rotation of the wheel 10 cause the distributing arm to the moved according to the opening cycle involving a fixed sequence (due to the rotations of the wheel 10, and, consequently, the feed according to a constant sequence of the sections 101 of the track).

It is noted that the rotation of the wheel 10 is obtained via disengaging means between the motor means and the wheel 10. These disengaging means comprise a driving wheel 5220 movably mounted between a position engaged with the wheel 10 wherein it rotates the wheel 10, and a position separated from the wheel 10 wherein the latter remains static.

A control system actuates a to-and-fro movement of the driving wheel 5220 with respect to the wheel 10, via a tilting lever.

According to the machines according to the prior art, this lever is connected to the end element of the distributing arm, such that the tilting downwards of the end element induces the tilting of the lever of the system for controlling the driving wheel tending to bring same in contact with the wheel 10 and rotate the latter.

As such, upon each tilting of the end element of the distributing arm, the driving wheel rotates the wheel 10 and the tracks borne thereby along an angular portion corresponding to one of the sections of the tracks, the duration of engagement of the driving wheel with the wheel 10 being calibrated by the duration of the tilted position of the end element of the distributing arm, noting that, once the pin has left the end element, the latter is returned to the high position by elastic return means.

The assembly described above, with the various constituent parts thereof, corresponds to the existing machines known in the art, but also constitutes the basic assembly of a machine for setting up bowling pins according to the invention.

As such, according to the principle of the invention, the machine further comprises a secondary system 5 intended to interfere with the primary positioning system as described above, this secondary system comprising:

- control means 51, 52 of the rotation of the lifting wheel, these control means being intended to stop the rotation of the lifting wheel 10 after each pin delivered to the distributing arm;
- selection means 53, devised to enable a user to define a chosen position, i.e. define a position chosen from the predetermined positions with a view to the set-up, by the machine, of a pin in the chosen position;
- an automatic control system 540 acting as means for activating/shutting down the primary system and authorising the operating cycle of the primary system until the chosen position has been reached, i.e. until the distributing arm is conveyed in correspondence with the position chosen from the predetermined positions.

The selection means 53 may be described according to various alternative embodiments that can be envisaged, of which:

- they are integrated in an interface of a software application executed by a tablet, or a smartphone or a computer;

they are accessible via an interface of software executed by a terminal comprising for example a touch screen, present at the end of lane at the level of the release zone.

The secondary system uses, according to the present embodiment, a support frame 50 intended to support some constituent elements of the secondary system.

Figure 2:
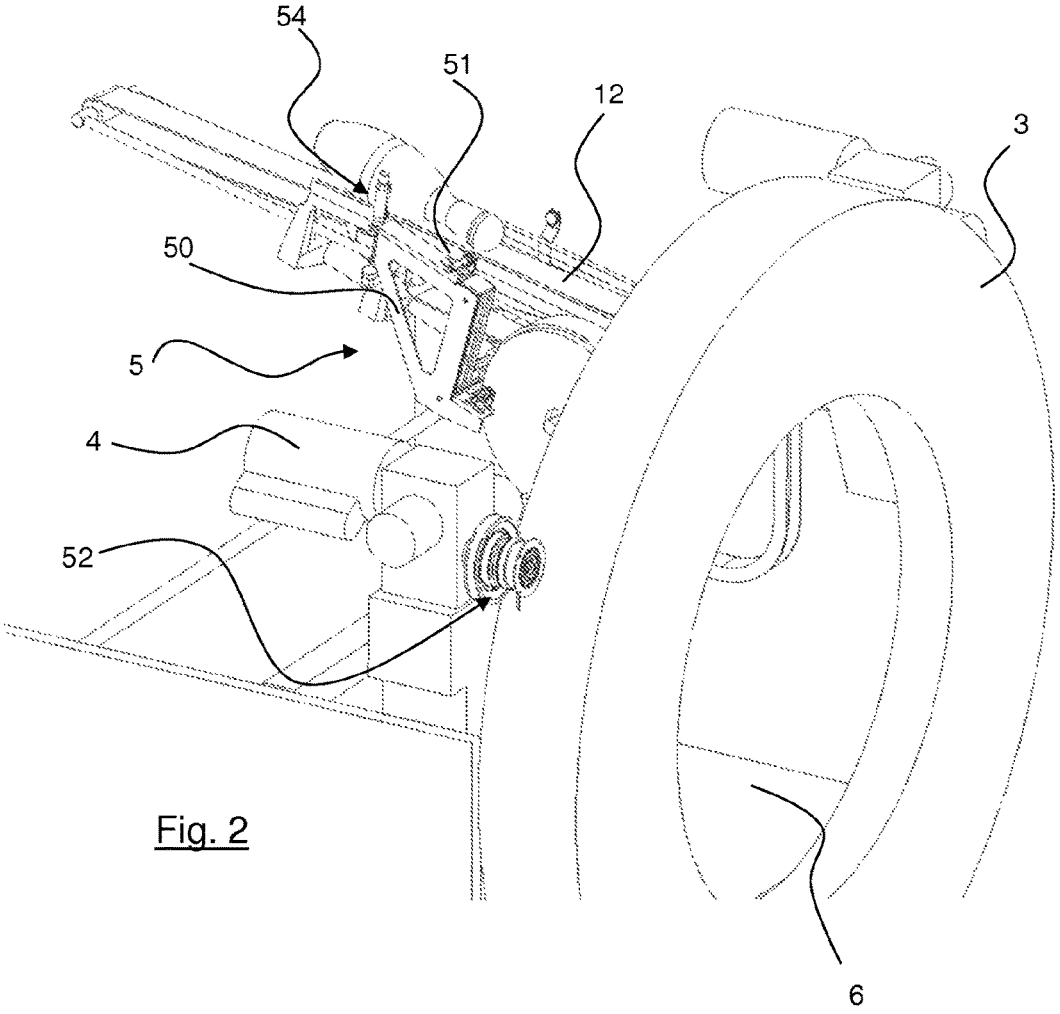
FIG. 2 is a perspective view of a machine for setting of bowling pins according to the invention, viewed from the lane side.
Figure 3:
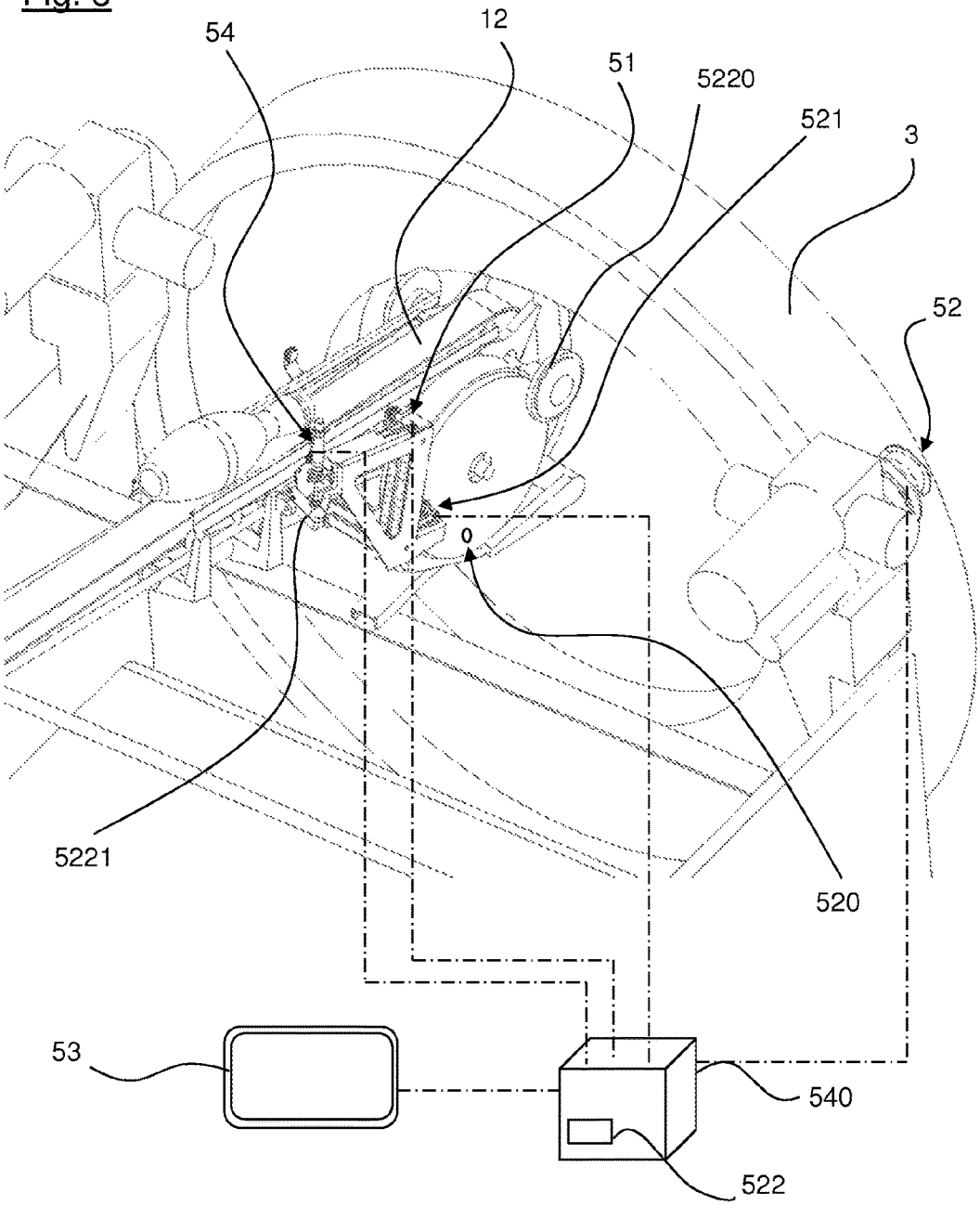
FIG. 3 is a detailed view of a machine for setting up bowling pins according to the invention.

This support frame is rigidly connected to the distributing arm, at the side whereof as illustrated by FIGS. 2 and 3.

With reference to FIGS. 2 and 3, the means for controlling the rotation of the lifting wheel comprise:

- a presence sensor 51, borne by the support frame at a distance from the lifting wheel (approximately the length of a pin in the reclined position or the height when it is upright), this sensor being intended to detect a pin conveyed by the distributing arm when it passes in front of the sensor, the latter then emitting an electrical signal;
- disengaging means 52, between the motor means 4 and the lifting wheel 3, these disengaging means being controlled by the presence sensor.

According to one preferential embodiment, the disengaging means 52 consist of an electromagnetic pulley actuated by motor means, and conveyed to the disengaged position under the instruction of the electrical signal emitted by the presence sensor of a pin on the distributing arm if applicable.

In the absence of this signal, the electromagnetic pulley rotates by default, the rotation of the pulley being resumed after having unloaded the pin in the chosen position and after having positioned the distributing arm in a new chosen position to be reached.

As described above, the primary system of the machines according to the invention comprises a wheel having a track 100 defining an operating cycle moving the distributing arm, the track having a succession of sections 101.

According to the present embodiment of the invention, the means for activating/shutting down the primary system comprise:

- at least one marker 520 for a "zero" position of the distributing arm (this position being the reference position for starting an operating cycle);
- means for reading 521 the marker;
- means for controlling 522 the rotation of the wheel suitable for making a computation of the number of sections to be fed (by successive fractions of rotation of the wheel, each fraction corresponding to the angular stroke whereon a section extends) to reach the chosen position from the marker.

Preferentially, the means for reading the marker consist of at least one inductive sensor, suitable for detecting the marker of the "zero" position, and for emitting a signal transmitted to an automatic control system 540 (including control means 522) of the machine which, prior to an operating cycle, rotates the wheel until the marker is conveyed opposite the inductive sensor. The distributing arm is then in the "zero" position. The control means compute the number of sections to be fed from the "zero" position in order to rotate the wheel according to this computation and, consequently, position the distributing arm in the chosen position.

Furthermore, it is noted that the means for controlling the rotation of the wheel comprise primary disengaging means in the form of a driving wheel 5220 as described above, carrying out the transmission between the motor means 4 and the wheel 10, with a control lever 5221 of this driving wheel.

In this context, the secondary system comprises an actuation system 54 of the control lever, via the automatic control system 540 of the machine, envisaged to actuate the lever with successive pulses according to the computation made by the control means: the number of pulses is equal to the number of sections to be fed from the "zero" position.

As illustrated by FIGS. 2 and 3, the actuation system 54 of the control lever comprises a cylinder wherein the piston is coupled with the control lever, the cylinder being borne by the support frame of the secondary system, and being controlled by the automatic control system in order to press on the control lever as many times as required in order to rotate the wheel and, consequently, feeding the sections until the section corresponding to the chosen position has been reached.

A typical operation of a machine for setting up bowling pins according to the invention may be performed as follows:

- after a ball throw performed by the player, the automatic control system of the machine actuates the removal of the pins from the lane, which results in all the pins being conveyed to the conveyor belt, the lifting wheel being stopped;
- the player chooses the configuration of pins that he/she wishes to play, via the selection means of the machine;
- according to the chosen position, the distributing arm is positioned;
- the lifting wheel actuates a pin present on the conveyor belt and actuates same until it is released on the distributing arm;
- when the pin passes in front of the presence sensor of the distributing arm, the lifting wheel is stopped.

Optionally, if the player has selected a plurality of pins to be positioned, this cycle is repeated for the new position.

An exemplary embodiment of the invention proposed a solution particularly meeting the requirement described above in the Background section.

Although the present disclosure has been described with reference to one or more examples, workers skilled in the art will recognize that changes may be made in form and detail without departing from the scope of the disclosure and/or the appended claims.

The invention claimed is:

1. A machine for setting up bowling pins in predetermined positions, comprising:

- a movable distributing arm arranged to release the pins one by one each at one of the predetermined positions;
- a primary positioning system, which is arranged to position the distributing arm with respect to the predetermined positions, the primary positioning system having an operating cycle moving the distributing arm according to a fixed sequence;
- a lifting wheel, which is arranged to deliver the pins to the distributing arm;
- at least one motor, connected to move the primary positioning system and the lifting wheel, the at least one motor moving the positioning system through the fixed sequence by a driving wheel; and
- a secondary positioning system comprising:
  - a presence sensor mounted to the distributing arm, which emits a first signal in response to a pin delivered to the distributing arm by the lifting wheel;
  - a first actuator, between the at least one motor and the lifting wheel, which disengages the at least one motor from the lifting wheel in response to the first signal so that the lifting wheel stops after each pin is delivered to the distributing arm;

a second actuator connected to actuate the driving wheel to move the primary positioning system and thus the distributing arm a selected number of positions of the fixed sequence in response to a second signal received from a control system and corresponding to a pin position chosen by a user from the predetermined positions.

2. The machine according to claim 1, wherein the first actuator comprises at least one electromagnetic pulley.

3. The machine according to claim 1, wherein the primary positioning system comprises:

a slave lever connected to move the distributing arm;

a sequencing wheel driven by the driving wheel and having a track followed by the slave lever and defining the operating cycle to move the distributing arm, the track having a succession of sections, each section arranged to move the distributing arm into one of the predetermined positions, and wherein the secondary positioning system further comprises:

at least one marker on the sequencing wheel identifying a starting position of the distributing arm;

a second sensor positioned relative to the sequencing wheel to detect the marker when the distributing arm is in the starting position.

4. The machine according to claim 3, wherein:

the primary positioning system further comprises a tilt lever, which is movable to engage and disengage the driving wheel to and from the sequencing wheel;

the second signal comprises a number of successive pulses corresponding to the chosen pin position;

the second actuator comprises a piston that actuates the tilt lever to engage the driving wheel to the sequencing wheel once in response to each pulse of the second signal, each engagement of the driving wheel to the sequencing wheel advancing the sequencing wheel by one of the sections along the track.

5. The machine according to claim 1, further comprising the control system, which is configured to receive the pin position chosen by the user and generate the first and second signals in response to the chosen pin position.

6. The machine according to claim 3, wherein the second sensor comprises at least one inductive sensor.

7. The machine according to claim 1, further comprising a portable computing selection device selected from the group consisting of a tablet, a smartphone and a computer, which is coupled to the control system and configured to receive the pin position selection from the user and provide the selection to the control system.

8. A secondary positioning system intended to be integrated in machines for setting up bowling pins in predetermined positions comprising:

a movable distributing arm arranged to release the pins one by one each at one of the predetermined positions;

a primary positioning system arranged to position the distributing arm with respect to the predetermined positions, the primary positioning system having an operating cycle moving the distributing arm according to a fixed sequence;

a lifting wheel, which delivers the pins to the distributing arm; and at least one motor, which moves the primary positioning system and the lifting wheel, the at least one motor moving the primary positioning system through the fixed sequence by a driving wheel;

wherein the secondary positioning system comprises:

a presence sensor mounted to the distributing arm, which emits a first signal in response to a pin delivered to the distributing arm by the lifting wheel;

a first actuator, between the at least one motor and the lifting wheel, which disengages the at least one motor from the lifting wheel in response to the first signal so that the lifting wheel stops after each pin is delivered to the distributing arm;

a second actuator connected to actuate the driving wheel to move the primary positioning system and thus the distributing arm a selected number of positions of the fixed sequence in response to a second signal received from a control system and corresponding to a pin position chosen by a user from the predetermined positions.

* * * * *